United States Patent [19]

Goede

[11] Patent Number: 4,673,003

[45] Date of Patent: Jun. 16, 1987

[54] STOPPING MECHANISM FOR A GRIPPER SHUTTLE LOOM

[75] Inventor: Simon Goede, Wetzikon, Switzerland

[73] Assignee: Zellweger Uster Ltd., Uster, Switzerland

[21] Appl. No.: 903,756

[22] Filed: Sep. 5, 1986

[30] Foreign Application Priority Data

Sep. 6, 1985 [CH] Switzerland ..... 03863/85

[51] Int. Cl.[4] ..... D03D 51/40

[52] U.S. Cl. ..... 139/342

[58] Field of Search ..... 139/341, 342, 183, 439

[56] References Cited

U.S. PATENT DOCUMENTS

| | | | |
|---|---|---|---|
| 3,124,166 | 3/1964 | Pfarrwaller | 139/342 |
| 4,192,354 | 3/1980 | Pfarrwaller | 139/439 |
| 4,527,598 | 7/1985 | Walch | 139/341 |

*Primary Examiner*—Henry S. Jaudon

*Attorney, Agent, or Firm*—Burns, Doane, Swecker & Mathis

[57] ABSTRACT

A stopping mechanism includes a brake device for an insertion device and a detector for determining the position of the insertion device. The detector includes a sensor which subjects the insertion device to electromagnetic radiation in the microwave range and operates on the Doppler principle. The position of the insertion device is determined by counting the number of crossover points of the Doppler signal in relation to a reference position. The detector has a high degree of resolution and is particularly suitable for looms using gripper shuttles. It is also highly flexible in the location in which the sensor may be arranged in the stopping mechanism.

18 Claims, 1 Drawing Figure

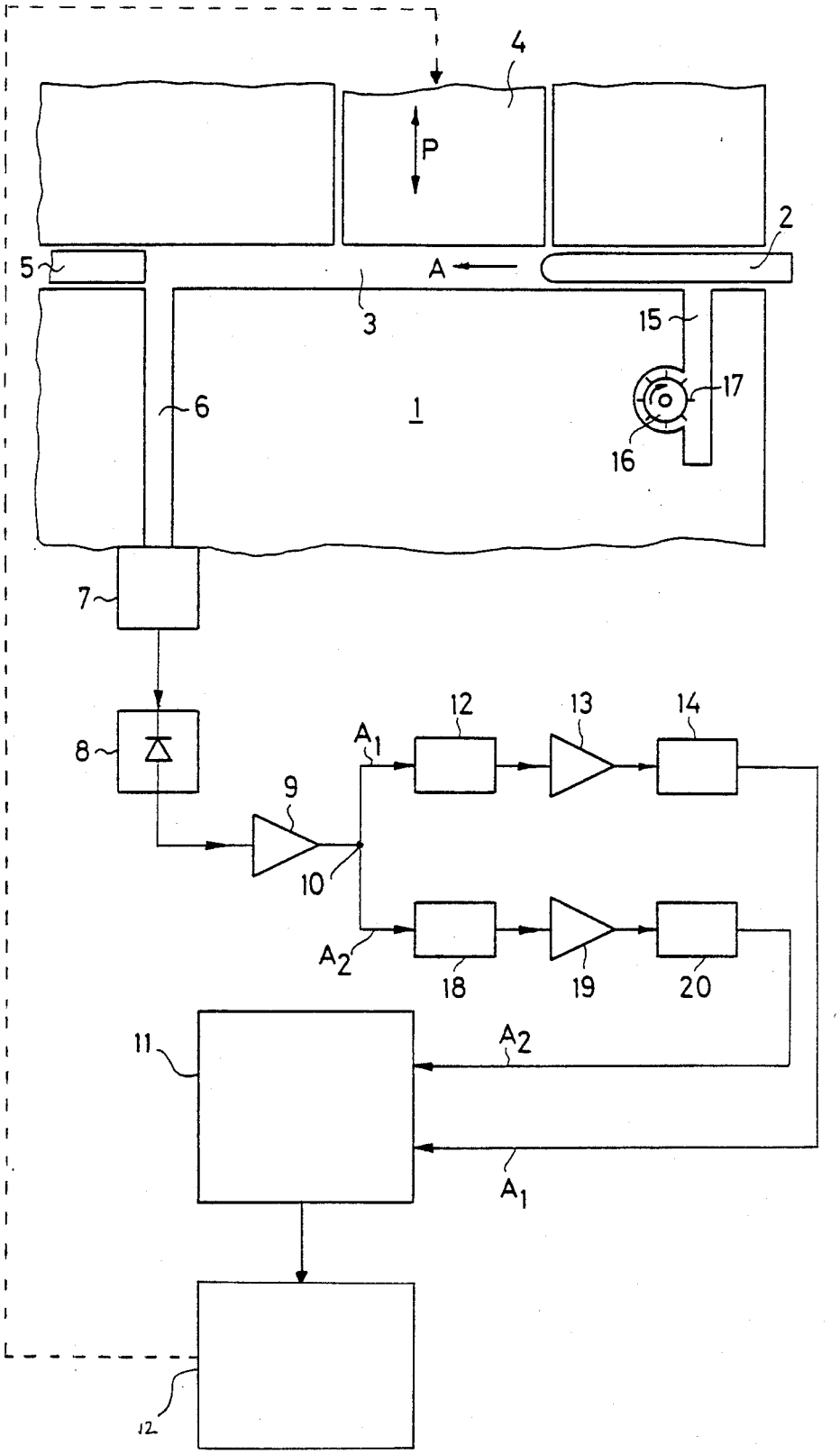
4
P
2
5
A
3
15
17
6
1
16
7
8
12
13
14
A1
9
10
A2
18
19
20
11
A2
A1
12

STOPPING MECHANISM FOR A GRIPPER SHUTTLE LOOM

BACKGROUND OF THE INVENTION

The present invention relates to a stopping mechanism for the weft thread insertion device of a weaving loom. More particularly, the invention relates to a brake for the insertion device and a detector for determining the position of the insertion device in the stopping mechanism.

Stopping mechanisms of this kind are used especially in looms operating with gripper shuttles. These looms include a large number of gripper shuttles in continuous circulation which must come to a standstill in approximately the same position. Since the various gripper shuttles have certain individual differences, the braking device requires constant readjustment while the loom is in operation. Readjustment is achieved by reference to the position of the gripper shuttles in the stopping mechanism as determined by the detector.

Various catching mechanisms for use in gripper shuttle looms are known in the prior art. For example, U.S. Pat. No. 3,124,166 to Pfarrwaller discloses a shuttle receiving mechanism for a gripper shuttle loom including a brake for stopping the shuttles at a predetermined location within the shuttle receiving mechanism. The catching mechanism includes a pair of "feelers" provided along the shuttle path indicating the stopping position of the shuttle. A first feeler is positioned at a portion of the shuttle path which defines the minimum length of the shuttle path and a second feeler is positioned at another portion of the shuttle path which corresponds to the maximum length of the shuttle path. Thus, the gripper shuttles ideally stop at a position between the first feeler and the second feeler. If the shuttle does not stop in the desired location, the brake is adjusted until the shuttle stops between the first feeler and the second feeler. A similar catching device for a gripper shuttle loom is disclosed in U.S. Pat. No. 4,192,354 to Pfarrwaller.

Other prior art detector devices for gripper shuttle loom catching mechanisms operate on the principle of magnetic induction and in most cases use several sensors for each stopping mechanism. Apart from the fact that as the demand for accuracy in determining the position increases the number of sensors and hence the expense of the system increases, these detector devices also entail certain restrictions in construction since the detectors must be arranged near or possibly inside the braking device, thus causing space problems and preventing optimum layout of the braking device. Another disadvantage of these known detectors arises from the fact that new designs of gripper shuttles contain an ever increasing proportion of plastic materials and a reduced amount of steel so that inductive sensors suitable for detecting the shuttles are increasingly bulky and thus considerably aggravate problems associated with space limitations.

The present invention provides a gripper shuttle loom stopping mechanism in which the detector device determines the position of the gripper shuttle with a high degree of resolution and can be installed at a considerable distance from the brake. Additionally, the detector device of the present invention requires no mechanical objects to be positioned within the path of the gripper shuttle.

BRIEF SUMMARY OF THE INVENTION

In accordance with the present invention, the detector device includes a sensor which exposes the insertion device to electromagnetic radiation in the microwave range and operates on the Doppler principle. The position of the insertion device is determined by the number of crossover points of the Doppler signal in relation to a reference position.

The microwave radiation equipment used in the present invention may be similar to that in a radar device of the kind used, for example, for monitoring traffic. In the invention, the superimposition of the beam reflected by the moving gripper shuttle and the emitted beam gives rise to a low frequency alternating voltage with a Doppler frequency which passes through one complete vibration for every half wavelength of the hollow wave guide. The occurrence of two crossover points of this alternating voltage therefore corresponds to a certain length of path traversed by the gripper shuttle. By counting the number of crossover points it is possible to determine the distance of the shuttle from a reference position and hence also the position of the shuttle itself. This operation is carried out with a very high degree of resolution and space problems are completely eliminated since there are many degrees of freedom for the arrangement of the microwave sensor.

A preferred embodiment of the stopping mechanism according to the invention includes a reference element which is provided for the reference position and which is subjected to the microwave radiation and causes a characteristic Doppler signal which is different from that caused by the weft thread insertion device. The Doppler signal caused by this reference element is interrupted by an insertion device moving into or situated inside the stopping mechanism.

The preferred embodiment has the advantage that due to the presence of the reference element according to the invention, the detector device not only responds to a moving gripper shuttle and determines its position of rest but also indicates the presence of a gripper shuttle in the stopping mechanism. The latter function is important because each gripper shuttle must be removed from the channel of the stopping mechanism before the next weft insertion can take place. The stopping mechanism according to the present invention thus provides the possibility of a simple method of monitoring the presence of a gripper shuttle in the stopping device.

BRIEF DESCRIPTION OF THE DRAWING

Various objects, features and advantages of the present invention will become apparent from the following detailed description when read in conjunction with the accompanying drawing, in which a preferred embodiment of the present invention is schematically represented.

DETAILED DESCRIPTION OF THE PREFERRED EMBODIMENT

Referring to FIG. 1, the stopping mechanism 1 includes a gripper shuttle 2 which draws a weft thread through a shed in the direction of the arrow A and is braked until it comes to a complete standstill. For this purpose, the stopping mechanism 1 comprises a channel 3 and a braking device 4 for the gripper shuttle 2. The braking device 4 includes a brake block having a lining which forms part of a side wall of the channel 3. The position of the brake block is adjustable in the direction of the double arrow P. After the shuttle 2 has been braked by the braking device 4, it is pushed back by a recoil device 5 into an ejection position whereat the thread clamp of the gripper shuttle 2 is opened. Ejector mechanisms for use in gripper shuttle looms are disclosed, for example, in U.S. Pat. No. 4,338,973 to Stauner and in U.S. Pat. No. 4,460,021 to Demuth et al. The disclosures of these patents are hereby incorporated by reference. The shuttle 2 is then transferred to a return chain conveyor for the next weaving cycle. U.S. Pat. No. 2,696,222 to Pfarrwaller and U.S. Pat. No. 3,881,524 disclose mechanisms for returning gripper shuttles for subsequent weaving cycles. The disclosures of these patents are hereby incorporated by reference.

The gripper shuttle 2 which has just entered the stopping device, the shuttle which is about to enter the stopping device and the shuttle which is about to be put on its return journey are each at separate portions of the weaving cycle. The various gripper shuttles 2 in this cycle will usually differ, even if only slightly, in their dimensions and their surface characteristics. Nevertheless, all the different gripper shuttles 2 should always come to a standstill at approximately the same position. The braking device 4 must therefore be adjustable, the adjustment requiring the detection of the position of rest of the gripper shuttle 2. If more than 400 weft insertions per minute take place in a weaving loom two meters in width, the adjustment of the braking device 4 cannot be carried out in "real time" at the precise moment when a given gripper shuttle 2 enters the channel 3. However, the rest positions of the individual gripper shuttles can be checked over several cycles and the braking device 4 may then be adjusted accordingly.

Alternatively, since the individual gripper shuttles 2 are moving in a cycle, the rest position may be determined for each gripper shuttle 2 and the braking device 4 for each shuttle 2 may then be controlled individually with the aid of the detected rest positions. For example, the stopping distance of the individual shuttles during a first cycle could be stored in a memory, and the value stored in the memory could be used to control the braking device when the particular shuttle is used in the next cycle.

Which of the two methods is employed is up to the operator responsible but each of these methods eliminates the need for readjustment of the brake 4 by hand and ensures that not only differences between the individual gripper shuttles but also wear and tear of the linings of the brake 4 are compensated for and corrected. Irregular operating conditions leading to damage of parts or stoppage of the loom are therefore avoided.

The position of the gripper shuttles 2 is detected by equipment which may be similar to a miniaturized radar apparatus of the kind used for monitoring and controlling the speed of traffic. According to the drawing, a stopping channel 3 of the stopping mechanism 1 in which the brake 4 and recoil device 5 are situated is in the form of a hollow wave guide for electromagnetic radiation in the microwave range. A microwave module or Doppler transceiver 7 is arranged in a side channel 6 of the stopping channel 3. The exact location of the side channel 6 may vary within wide limits, for example between the brake device 4 and the recoil device 5, as shown in the drawing.

The microwave module 7, for example a "K-band Doppler Transceiver" of the type MA 86857 of Macom Gollium Arsenide Products Inc., Burlington, Mass., USA, emits an electromagnetic beam in the microwave range, and this beam enters the stopping channel 3 through the side channel 6 and finally leaves the stopping channel 3 at the outlet end which in the drawing is situated on the righthand side of the stopping mechanism 1. The previously concentrated beam fans out at this exit. Before its entry into the stopping channel 3, a gripper shuttle 2 shot through the shed in the direction of the arrow A will reflect only a very small proportion of the beam into the stopping channel 3 to reach the microwave module 7. However, once the head of the shuttle 2 enters the stopping channel 3 the proportion of the reflected radiation of the now concentrated beam increases suddenly, so that the moment of entry of the gripper shuttle 2 into the stopping channel 3 can be accurately recorded by means of a suitably adjusted threshold detector on the microwave module 7.

The radiation reflected by the gripper shuttle 2 is received by the microwave module 7 and passes through a receiving filter to a mixer 8, preferably a mixer diode, where a small proportion of the radiation emitted by the microwave module 7 is superimposed on it. The receiving filter and the mixer diode 8 may be contained inside the microwave module 7. In the FIGURE, the mixer diode 8 has been shown as a separate part purely for the sake of clarity. As is well known, this superimposition of the two beams gives rise to a low frequency alternating voltage between the electrodes of the mixer diode, known as a Doppler signal whose frequency, the Doppler frequency, is proportional to the velocity of the gripper shuttle 2. The Doppler frequency will decrease as the gripper shuttle slows. When the gripper shuttle comes to a stop, the Doppler frequency will be zero.

As noted above, the Doppler frequency (cycles/-second) is proportional to the velocity (meters/second) of the gripper shuttle 2. Hence, the Doppler frequency is equal to the velocity of the gripper shuttle multiplied by a proportionality factor. The value of this proportionality factor is related to the wavelength of the microwave signal being transmitted in the stopping channel 3. By cancelling the units of time from the relationship, it is evident that the number of cycles in the Doppler signal is proportional to the distance covered by the gripper shuttle.

Since the proportionality constant is determined by the waveguide wavelength, there is a fixed relationship between the distance travelled by the gripper shuttle 2 and the detected number of cycles of the Doppler signal. For each complete cycle of the Doppler signal, the gripper shuttle travels a distance corresponding to one half of the wavelength of the radiation in the stopping channel 3, which acts as a waveguide. Thus, if the wavelength of the waveguide signal is known, the distance travelled by the gripper shuttle between the time it enters the waveguide and the time it stops can be determined by counting the number of cycles in the Doppler signal before the gripper shuttle comes to a rest.

In each cycle of the Doppler signal, there will be two crossover points. Hence, the distance between two crossover points represents a half cycle of the Doppler signal. Since it is known that the distance travelled by the gripper shuttle 2 during each cycle of the Doppler signal is equal to one half waveguide wavelength, the distance travelled by the gripper shuttle 2 between two crossover points of the Doppler signal is one quarter of the waveguide wavelength. Accordingly, by counting the crossover points of the Doppler signal as the gripper shuttle slows, an indication of the total distance travelled by the gripper shuttle between entering the stopping channel 3 and coming to rest is obtained.

The following concrete data are obtained when the above mentioned "K-Band Doppler Transceiver" is used as microwave module 7. The transmitting frequency is 24,150 GHz and the free space wavelength $\lambda = 12.42$ mm. Inside the waveguide (stopping channel 3), the wavelength depends on the width of the channel. When the width a of the stopping channel 3 is 15 mm, the cutoff wavelength $\lambda_c$ for the channel is given by $\lambda_c = 2a = 30$ mm. The waveguide wavelength $\lambda_g$ may be calculated from the values for $\lambda$ and $\lambda_c$ according to the following formula:

$$\lambda_g = \frac{\lambda}{\sqrt{1 - (\lambda/\lambda_c)^2}}$$

In this specific example, $\lambda_g = 13.65$ mm. One crossover point therefore appears in the Doppler signal for each distance of $\lambda_g/4 = 3.41$ mm travelled by the shuttle 2 in the stopping channel 3. The number of these crossover points multiplied by this given path length is therefore a direct indication of the total distance of the stopped gripper shuttle 2 from the inlet of the stopping channel 3. At a maximum shuttle velocity of 50 m/sec, the Doppler frequency $f_D$ is approximately 14.6 kHz. Of course when the gripper shuttle is at rest, the Doppler frequency $f_D$ is zero.

When determining the rest position of the shuttle 2 by counting the crossover points of the Doppler signal, the shuttle is considered to be completely stopped when no further crossover points are recorded within a given time.

The Doppler signal of the mixer 8 passes through an amplifier 9 to a junction 10 from which two evaluating lines A1 and A2 lead to a processor 11 which evaluates the Doppler signal. The first line A1 deals with the Doppler signal described above, and contains, in known manner, a first filter 12, e.g. a low pass filter which blocks frequencies above the Doppler frequency $f_D$ for the maximum velocity, an amplifier 13 and a Schmitt trigger 14. The processor 11 calculates the stopping position of the shuttles and provides a control signal to the brake adjustment apparatus 12. The brake adjustment apparatus then sets the braking device 4 at the desired position.

Instead of using the point of entry of the gripper shuttle 2 into the channel 3, some other reference position may be chosen for counting the crossover points. For example, a side channel 15 containing a reference element 16 opens into the stopping channel 3 just behind the entrance to the channel. This reference element reflects a signal to the sensor 7 along the channels 15, 3 and 6. This signal is interrupted when a gripper shuttle 2 covers the opening into the side channel 15 and does not reach the sensor 7 until the gripper shuttle 2 has left the stopping channel 3. If the gripper shuttle 2 does not completely fill the cross-section of the stopping channel 3, the signal may not completely disappear, but it will be considerably attenuated.

The reference element 16 thus not only provides the desired reference position but also enables the gripper shuttle 2 to be statically monitored in that the absence or attenuation of the signal from the reference element 16 indicates the presence of a gripper shuttle 2 in the channel 3.

If a gripper shuttle 2 is stuck in the channel 3, it may cause considerable trouble, especially if it projects at the rear end, as in the FIGURE. This situation may be included in the monitoring process by choosing the distance between the side channel 15 and inlet opening of the stopping channel 3 to be at least equal to the length of a shuttle 2. In that case, the information "shuttle in the channel" does not appear until the shuttle 2 is completely inside the stopping channel 3.

There are many possible embodiments of reference elements 16. The one illustrated in the drawing also causes a Doppler signal. It consists of a small wheel rotatably mounted in the side channel 15 and having projecting blades 17, only one of which is completely inside the side channel 15 at any given moment. When this wheel is rotated, it acts as modulator on the microwave radiation emitted by the sensor 7 in that each blade 17 situated in the side channel 15 reflects part of this radiation so that a Doppler signal is produced at the mixer diode 8. With suitable choice of the speed of rotation of the wheel, this Doppler signal will have a substantially higher frequency than the maximum frequency of the Doppler signal produced by a gripper shuttle 2. If the maximum Doppler frequency of the gripper shuttle is, say, 15 kHz, then the reference element 16 should produce a Doppler frequency of about 25 kHz.

After the Doppler signal of the reference element 16 has been amplified, it enters the second evaluation line A2 due to the blocking effect of the low pass filter 12. The signal then passes through a second filter 18, an amplifier 19 and a rectifier 20. The second filter 18 blocks signals having a frequency in the region of the Doppler frequency produced by a gripper shuttle 2 and may consist, for example, of a high pass filter. A logic signal having a value of "1" is transmitted to the processor 11 by the rectifier 20 so long as no gripper shuttle 2 is situated between the sensor 7 and the reference element 16. At all other times, the input signal of the processor 11 on the line A2 is at logic level "0".

The reference element 16 could alternatively consist of a small neon tube which produces a characteristic noise in the sensor 7 when the communication to the sensor 7 is not blocked.

There are, of course, also other possible variations in which the microwave radiation of the sensor 7 is not modulated or influenced but the reference position is obtained from some other device, for example a light barrier or other suitable sensor situated at the entry to the stopping channel 3.

Lastly, it should be remembered that the reference element 16 is not essential for determining the position of the braked gripper shuttle. This element is necessary only if additional functions of the type described above are to be monitored in the stopping mechanism 1.

The principles, preferred embodiments and modes of operation of the present invention have been described in the foregoing specification. The invention which is intended to be protected herein, however, is not to be construed as being limited to the particular forms disclosed, since these are to be regarded as illustrative rather than restrictive. Variations and changes may be made by those skilled in the art without departing from the spirit of the invention.

What is claimed is:

1. A catching mechanism for a weft thread insertion device of a weaving loom, comprising:

a stopping channel including a receiving end for receiving said weft thread insertion device;

braking means for stopping said insertion device in said stopping channel; and detector means for determining the position of the device in said stopping channel, said detector means including sensing means for subjecting the insertion device to an electromagnetic radiation signal in the microwave range and detecting a radiation signal reflected from said weft thread insertion device, said detector means operating on the Doppler principle to determine from the number of crossover points of the Doppler signal the position of the insertion device relative to a reference position.

2. The catching mechanism of claim 1, wherein said reference position is the position at which the insertion device enters the stopping mechanism.

3. The catching mechanism of claim 2, wherein said sensing means includes a Doppler transceiver arranged in a first side channel of the stopping channel of the catching mechanism.

4. The catching mechanism of claim 3, wherein said first side channel branches off the stopping channel at a position spaced from said receiving end of said stopping channel.

5. The catching mechanism of claim 1, further including a reference element which is provided at said reference position and is subjected to said microwave radiation signal, said reference element causing a reference Doppler signal different than the radiation signal reflected from said weft thread insertion device, the production of said reference Doppler signal being interrupted by an insertion device moving into or situated in the catching mechanism.

6. The catching mechanism of claim 5, wherein said reference element is provided in a second side channel of the stopping channel situated between said first side channel and said receiving end of said stopping channel and wherein communication between the reference element and the sensing means is interrupted by an insertion device passing over the opening into the second side channel and is not reestablished until the insertion device is removed from the stopping channel.

7. The catching mechanism of claim 5, wherein said sensing means includes a Doppler transceiver arranged in a first side channel of the stopping channel of the catching mechanism.

8. The catching mechanism of claim 7, wherein said first side channel branches off the stopping channel at a position spaced from said receiving end of said stopping channel.

9. The catching mechanism of claim 8, wherein said reference element is provided in a second side channel of the stopping channel situated between said first side channel and said receiving end of said stopping channel and wherein communication between the reference element and the sensing means is interrupted by an insertion device passing over the opening into the second side channel and is not reestablished until the insertion device is removed from the stopping channel.

10. The catching mechanism of claim 9, wherein said reference element includes a driven element having a movement which produces said reference Doppler signal, said reference Doppler signal having a frequency substantially higher than the frequency of said signal reflected from said insertion device.

11. The catching mechanism of claim 10, wherein said reference element includes a rotary wheel having a plurality of radially extending blades, at least one of said blades at any moment extending into said second side channel to reflect said microwave radiation signal.

12. The catching mechanism of claim 6, wherein said reference element includes a driven element having a movement which causes said reference Doppler signal, said reference Doppler signal having a frequency substantially higher than the frequency of said signal caused by said insertion device.

13. The catching mechanism of claim 12, wherein said reference element includes a rotary wheel having a plurality of radially extending blades, at least one of said blades at any moment extending into said second side channel to reflect said microwave radiation signal.

14. The catching mechanism of claim 5, wherein said reference element includes a driven element having a movement which causes said reference Doppler signal, said reference Doppler signal having a frequency substantially higher than the frequency of said signal caused by said insertion device.

15. The catching mechanism of claim 1, wherein the signals received by said sensing means and said microwave radiation signal emitted by the sensing means are superimposed on each other in a mixing stage which is connected to a processor by two parallel evaluation lines.

16. The catching mechanism of claim 15, wherein said reflected Doppler signal is allocated to a first one of said two parallel evaluation lines and said Doppler signal produced by the reference element is allocated to a second one of said two parallel evaluation lines, said first one of said evaluation lines having a filter which blocks passage of a Doppler signal having the Doppler frequency allocated to said second one of said evaluation lines and said second one of said evaluation lines having a filter which blocks passage of a Doppler signal having the Doppler frequency allocated to said first one of said evaluation lines.

17. Stopping mechanism according to claim 6, wherein said reference element includes a fluorescent lamp.

18. Stopping mechanism according to claim 5, wherein said reference element includes a fluorescent lamp.

* * * * *